United States Patent [19]

McCracken et al.

[11] 3,972,528

[45] Aug. 3, 1976

[54] BASEBALL BAT GRIP

[75] Inventors: Leonard Dean McCracken, Arlington Heights; Thomas John Wallace, Crystal Lake, both of Ill.

[73] Assignee: Pepsico Inc., Purchase, N.Y.

[22] Filed: Feb. 14, 1975

[21] Appl. No.: 550,123

[52] U.S. Cl. ..... 273/72 A; 273/75; 273/81 R; 273/DIG. 10; 15/143 R; 74/551.9; 145/61 C; 427/256

[51] Int. Cl.[2] ..... A63B 59/06

[58] Field of Search ..... 273/67 R, 67 A, 67 DA, 273/72 R, 72 A, 73 J, 75, 76, 80 R, 80 B, 81 R, 81.5, 81.6, 82 A, 167 J, DIG. 8, DIG. 10, DIG. 29; 15/143 R; 74/551.9, 558, 558.5; 145/61 R, 61 C; 260/32.8 R, 33.6 R, 33.6 AQ, 33.8 R, 2.5 R; 43/23

[56] References Cited

UNITED STATES PATENTS

| | | | |
|---|---|---|---|
| 300,360 | 6/1884 | Gray | 273/72 R |
| 1,012,299 | 12/1911 | True | 273/81 R |
| 2,185,568 | 1/1940 | Ratner | 273/81 R X |
| 2,379,006 | 6/1945 | Johnson | 273/72 R |
| 2,583,198 | 1/1952 | Axton | 273/72 R X |
| 2,894,924 | 7/1959 | Rockoff | 273/DIG. 10 |
| 3,028,283 | 4/1962 | Lundgren et al. | 273/81 R X |
| 3,233,903 | 2/1966 | Satchell et al. | 273/82 A |
| 3,239,478 | 3/1966 | Harlan | 260/33.6 AQ X |
| 3,271,031 | 9/1966 | Mitchell | 273/DIG. 10 |
| 3,332,903 | 7/1967 | Kavalir | 260/32.8 R X |
| 3,400,095 | 9/1968 | Kremer et al. | 260/32.8 R |
| 3,489,031 | 1/1970 | Meier | 273/75 X |
| 3,606,326 | 9/1971 | Sparks et al. | 273/81 R |
| 3,727,295 | 4/1973 | Gildemeister | 273/72 A X |
| 3,798,185 | 3/1974 | Skiens et al. | 260/33.6 AQ X |
| 3,824,199 | 7/1974 | Nadeau et al. | 273/DIG. 8 |
| 3,904,720 | 9/1975 | Sjostrand | 273/75 X |

FOREIGN PATENTS OR APPLICATIONS

| | | | |
|---|---|---|---|
| 17,166 | 7/1897 | United Kingdom | 273/75 |
| 1,142,073 | 2/1969 | United Kingdom | 273/75 |
| 547,946 | 9/1942 | United Kingdom | 273/81 R |
| 601,756 | 5/1948 | United Kingdom | 273/81 R |
| 1,062,796 | 3/1967 | United Kingdom | 273/167 J |

OTHER PUBLICATIONS

"The Neoprenes" by Murray and Thompson; 1963; pp. 55–90.

*Primary Examiner*—Richard J. Apley

[57] ABSTRACT

A friction grip for the handles of bats, rackets and the like which has a permanent tacky feel increasing in tackiness as the hands of a user heat up and perspire is provided by coating the handle with a composition having a synthetic rubber base, an anti oxidant such as zinc oxide, a hydrocarbon tackifier such as rosin, a thickener and anti-slip material such as flocked silica, a blend of slow and fast evaporating solvents, and a defoamer. The grip has an open pore surface, and is permanently bonded to the handle by a mere drying of the composition. The bat or racket handle is preferably composed of metal, such as magnesium, and coated with a plastics base paint providing a barrier between the grip material and the metal body.

8 Claims, 4 Drawing Figures

10
11
11a
11b
11c
12
13
14
15
16
II
III

BASEBALL BAT GRIP

FIELD OF THE INVENTION

This invention relates to the art of friction hand grips for athletic equipment or sporting goods such as baseball or softball bats, tennis or squash rackets, table tennis paddles, and the like and specifically deals with a comfortable somewhat resilient friction grip for baseball or softball bats which will become tackier as the hands of the user heat up and perspire.

PRIOR ART

Heretofore hand grips for athletic or sporting goods equipment have been provided by friction tape, applied rubber sleeves, leather wrappings, and the like which are time consuming and expensive to apply, will easily loosen on the handle, and become slippery and uncomfortable after appreciable usage. It has, therefore, become the custom to apply a tacky substance to the bat or racket handle prior to each use but this practice is hard on the users hands leaving deposits which are difficult to remove causing lesions of the skin and inflicting possible infection.

SUMMARY OF THE INVENTION

This invention now eliminates the necessity for the mounting of separate hand grips on the handles of athletic or sporting goods equipment, eliminates the necessity for applying tacky materials before use of such equipment and coacts with the heat and perspiration of a users hand to develop an increased tackiness and friction.

The invention will hereinafter be described as embodied in a tubular magnesium baseball or softball bat especially adapted for Little League use where the users hands may be soft and tender. The grip of the invention is especially useful in protecting soft and tender hands while at the same time preventing the bat from slipping out of the users hands. It will, of course, be understood that the invention is not limited to this preferred embodiment since the grip of the invention is generally useful for the handles of all types of athletic or sporting goods equipment.

According to the specific embodiment of this invention, a hollow magnesium baseball bat, filled with a foamed polyurethane plastic and coated with a polyurethane pigmented paint has the handle or neck end thereof coated with a neoprene base material admixed with zinc oxide, flocked silica and rosin. The coating composition includes a blend of fast and slow drying organic solvents and a defoamer proportioned as to facilitate coating build-up while keeping the coated surface open or wet long enough to prevent skinning or future cracking or fissuring. The defoamer reduces surface tension to eliminate bubbles in the coating. The coating is applied to a desired thickness which will offer a cushioning effect. The finished coating has an open pore surface and the silica in the coating provides a sand paper-like feel. The grip increases in tackiness as the users hands get hotter and sweat.

The coating can be applied by dipping, spraying, brushing, roll and knife application, and extrusion. The grip has a long term life and is intimately bonded to the underlying bat coating or structure.

It is then an object of this invention to provide a grip for athletic and sporting goods equipment having a comfortable cushioned tacky feel and becoming tackier upon increase in temperature and application of moisture.

A specific object of the invention is to provide a baseball grip which feels resilient and becomes tackier as the users hands become hotter and perspire.

A further object of the invention is to provide a magnesium baseball bat with a permanently affixed grip coating on the handle end thereof which increases in tackiness during use.

Another object of the invention is to provide an inexpensive method of forming friction grips on the handles of athletic and sporting goods equipment.

A specific object of the invention is to provide a baseball or softball bat with a long lasting friction grip by dipping the handle end of the bat into a synthetic rubber base coating containing zinc oxide, rosin and silica, a blend of slow and fast drying solvents permitting build-up of a coating of desired thickness while preventing skinning of the coating during drying, and a de-foaming agent eliminating bubbles.

Other and further objects of this invention will be apparent to those skilled in this art from the following detailed description of the annexed sheet of drawings, which by way of a preferred embodiment only, illustrates a hollow magnesium baseball bat with the hand grip of this invention thereon.

AS SHOWN IN THE DRAWINGS

Figures 1, 2, 3, 4:
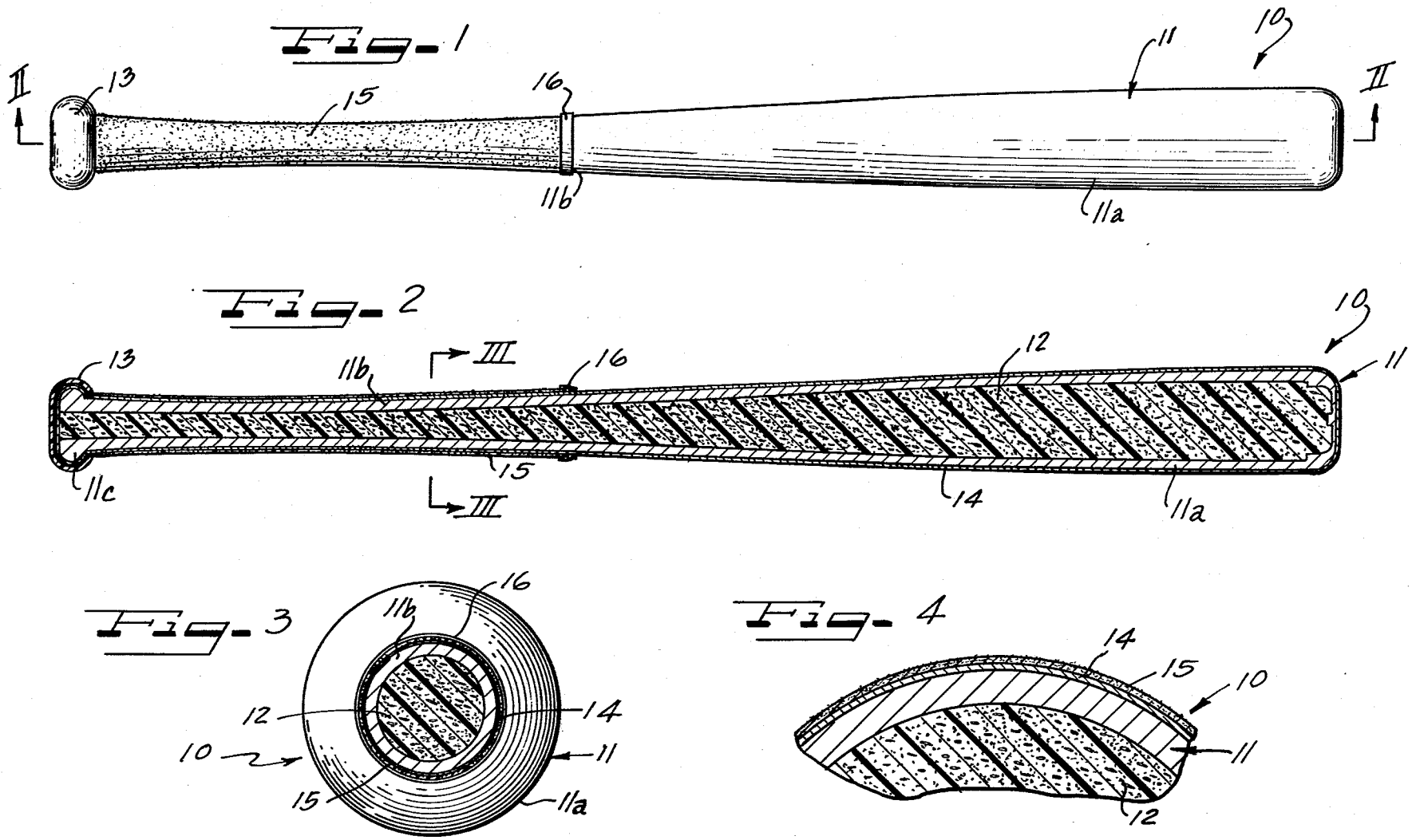
FIG. 1 is a side elevational view of a bat according to this invention having the friction grip of this invention on the handle thereof.
FIG. 2 is a longitudinal sectional view of the bat of FIG. 1 taken along the line II—II of FIG. 1.
FIG. 3 is a transverse sectional view of the bat of FIGS. 1 and 2 taken along the line III—III of FIG. 2.
FIG. 4 is a greatly enlarged transverse sectional view of the grip portion of the bat of FIGS. 1 to 3.

The bat 10 of FIGS. 1 to 3 is composed of a one piece tubular magnesium body 11 open at one end and closed by a welded-on cap at th other end, filled with plastics material such as foamed polyurethane 12. The body has a large diameter ball striking portion 11*a* tapering down to a smaller diameter handle portion 11*b* with a solid knob 11*c* on the terminal end of the handle portion 11*b*. A plastics cover 13 fits over the knob 11*c* closing the open end of the tube. This cover may be a molded plastics cup and is preferably cemented to the knob 11*c*.

The magnesium body 11 is coated with a film of paint 14 which covers the entire end and length of the body and may be composed of a polyurethane base paint pigmented with any color such as green, red, or the like. This coating 14 is dried in a conventional manner and suitable indicia may be silk screened on the dried coating.

According to this invention, the handle portion 11*b* of the coated bat body 11 is covered with a grip 15 integrated with the coating 14 on the handle portion 11*b*. The grip 15 extends over the knob 11*c* up to the portion of the bat body where it enters the impact zone and a collar of plastic film 16 is wrapped around the inner end portion of the grip 15 to provide a decorative line of demarcation between the striking and gripping zones of the bat body. Plastic tape may be used for the collar 16.

The grip is conveniently applied by dipping the handle end of the bat body 11 into a composition of the grip material before the cover 13 is applied to the knob 11*c*.

The coating composition is prepared, for example, by dissolving a synthetic rubber material such as neoprene in a mixture of aromatic and aliphatic organic solvents such as xylol and naphtha. A tackifier such as rosin, and an anti oxidant and stabilizer such as zinc oxide are added to the solution. Then a thickener and anti-slip material such as flocked silica is added, together with a defoamer such as polydimethyl siloxane. A pigment may be added to provide the desired color such as grey. A specific preferred formula is as follows:

| | | |
|---|---|---|
| Solvents | | |
| | Xylol | 57.7% by weight |
| | Naphtha | 26.3% by weight |
| | Butyl Cellusol | 16% by weight |
| Solids | | |
| | Flocked Silica | 6% by weight |
| | Neoprene | 67% by weight |
| | Rosin | 20% by weight |
| | Zinc Oxide | 7% by weight |

The solution is made to a 33% solids content.

Twenty ounces of an anti-foaming agent such as "Dow Corning 200", which is a trade name for polydimethyl siloxane is added to each gallon of the solution.

The proportions of the above specific formula and equivalents for the specific ingredients can be varied considerably. Viscosity of the finished coating composition should be controlled for achieving a desired coating thickness. A preferred coating application is a one dip immersion of the bat handle into the composition. A coating of about three to eight thousandths of an inch is desirable. The coating is conveniently oven dried for 10 minutes at 350°F.

In the above specific formula, for example, the xylol may be replaced with toluol, the naphtha replaced with heptane, and glycol ether used in place of butyl cellusol. The proportions can vary from 40 to 70% by weight of the xylol or its equivalent, from 15 to 40% by weight of naphtha or its equivalent and from 5 to 30% butyl cellusol or its equivalent.

The solids may vary using 1 to 7% by weight flocked silica or equivalent particulate anti slip material imparting thixotropic properties to the compositions, from 20 to 80% by weight neoprene or equivalent synthetic rubber such as nitrile rubber, styrene butadiene and the like, from 10 to 50% by weight rosin or equivalent tackifier resin, and from 3 to 20% by weight zinc oxide or equivalent stabilizers such as "Stabilite" a diphenyl propylenediamine manufactured by C. P. Hall Company of Akron, Ohio.

The resulting grip is resilient, has an open pore surface with a tacky feel. This tacky feel is permanent and gets tackier as the users hands get hotter or wetter due to perspiration. The grip has a long useful life, will not crack or fissure under extreme variations in temperature and humidity, will continue to present the anti-slip properties to the hands of the user affording a very high coefficient of friction.

From the above descriptions it will therefore be understood that this invention now provides a greatly improved hand grip for athletic and sporting goods equipment which is integrally bonded to the handles of the equipment, has a comfortable degree of resiliency, and continues to present anti-slip properties to the hands of the user.

We claim as our invention:

1. A bat which comprises a body having a necked-down handle portion and an enlarged knob at the end of the handle portion, an open pore resilient tacky friction grip coated on said handle portion and extending from the knob along the length of the handle portion, said grip coated on said handle portion being composed of a synthetic rubber base with a hydrocarbon tackifier material and an anti-slip material dispersed therein and a defoamer maintaining an open pore surface thereon, and said grip being sensitive to heat and moisture to become more tacky as the hands of a user of the bat heat up and perspire.

2. A baseball bat which comprises a hollow magnesium body having a large diameter striking portion with a closed end and a small diameter handle portion with a hollow enlarged open knob at the end of the handle portion, a foam plastic material filling said body, a polyurethane paint covering said body, a hand grip coating covering the polyurethane coating along the handle portion of the body, said hand grip coating being about 0.003 to 0.008 inches thick and being tacky and resilient with a high coefficient of friction and having an open pore surface and composed of a synthetic rubber base, zinc oxide, rosin, and flocked silica, a plastic cap covering the knob and open end of the hollow body, and said hand grip coating being sensitive to heat and moisture to become more tacky as the hands of a user of a bat heat up and perspire.

3. A device having a handle, and a friction grip for said handle which comprises an integral coating on said handle composed of a synthetic rubber, a tackifier, a stabilizer, an anti-slip material, and a defoamer, said coating being resilient, tacky, having an open pore surface and a high coefficient of friction and said coating being sensitive to heat and moisture to increase its grip capacity when the hand of a user perspires.

4. The device of claim 3 wherein the tackifier of the coating is rosin.

5. The device of claim 3 wherein the defoamer of the coating is a siloxane.

6. The device of claim 3 wherein the stabilizer of the coating is zinc oxide.

7. The device of claim 3 wherein the integral coating on the handle is composed of from 20 – 80% by weight neoprene, from 10 – 50% by weight rosin, from 3 – 20% by weight zinc oxide, from 1 – 7% by weight flocked silica and a relatively small amount of polydimethyl siloxane sufficient to prevent skin and bubble formation.

8. The method of making a device of claim 3 which comprises coating the handle of such device with a synthetic rubber composition containing zinc oxide, rosin, flocked silica, a defoamer and a mixture of aliphatic and aromatic organic solvents, controlling the thickness of the coating to about 0.003 to 0.008 inches to provide a resilient cushion on the handle, and evaporating the solvents at a slow rate to prevent formation of a skin on the coating.

* * * * *